US005135811A

United States Patent [19]

White et al.

[11] Patent Number: 5,135,811

[45] Date of Patent: Aug. 4, 1992

[54] POLYAMIDE YARN PROVIDED WITH A BUILT-IN ANTIBACTERIAL AND METHOD FOR ITS PRODUCTION

[75] Inventors: William C. White, Midland, Mich.; Yukio Yamahara; Koji Tajiri, both of Hiroshima, Japan

[73] Assignee: Dow Corning Corporation, Midland, Mich.

[21] Appl. No.: 10,890

[22] Filed: Feb. 4, 1987

[30] Foreign Application Priority Data

Feb. 4, 1986 [JP] Japan ..... 61-21222

[51] Int. Cl.[5] ..... D02G 3/00

[52] U.S. Cl. ..... 428/395; 57/250; 57/258; 428/375; 428/378; 428/394

[58] Field of Search ..... 428/375, 394, 395, 907, 428/378; 8/188, 115.64; 57/250, 258

[56] References Cited

U.S. PATENT DOCUMENTS

| | | | |
|---|---|---|---|
| 2,985,995 | 5/1961 | Bunting, Jr. et al. | 57/140 |
| 3,110,151 | 11/1963 | Bunting, Jr. et al. | 57/157 |
| 3,186,155 | 6/1965 | Breen et al. | 57/140 |
| 3,255,508 | 6/1969 | Weiss et al. | 28/1 |
| 3,543,353 | 12/1970 | Meehan | 24/16 |
| 3,803,282 | 4/1974 | Hamana et al. | 264/103 |
| 4,009,997 | 3/1977 | Greif | 8/554 |
| 4,106,901 | 8/1978 | Bishop et al. | 8/139 |
| 4,188,691 | 2/1980 | Matsumoto et al. | 28/255 |
| 4,247,476 | 1/1981 | Haase et al. | 544/59 |
| 4,268,940 | 5/1981 | Kuroda et al. | 28/255 |
| 4,371,577 | 2/1983 | Sato et al. | 428/96 |
| 4,394,378 | 7/1983 | Klein | 514/63 |
| 4,504,541 | 3/1985 | Yasuda et al. | 428/264 |
| 4,614,675 | 9/1986 | Ona et al. | 427/387 |
| 4,672,005 | 6/1987 | Dyer | 428/515 |
| 4,685,932 | 8/1987 | Guilbault et al. | 428/395 |
| 4,692,374 | 9/1987 | Bouchette | 428/288 |
| 4,699,627 | 10/1987 | Bailey | 8/602 |
| 4,766,113 | 8/1988 | West et al. | 514/187 |

FOREIGN PATENT DOCUMENTS

| | | |
|---|---|---|
| 51874 | 3/1982 | Japan . |
| 181364 | 9/1985 | Japan . |
| 185866 | 9/1985 | Japan . |
| 1273797 | 5/1972 | United Kingdom . |

*Primary Examiner*—Lorraine T. Kendell
*Attorney, Agent, or Firm*—Jim L. DeCesare

[57] ABSTRACT

Polyamide yarn provided with a built-in antimicrobial capacity characterized by the adhesive on the fiber surface of an antimicrobial agent comprising an organosilicon quaternary ammonium salt and a surfactant comprising an alkyl-, aryl-, alkenyl-, or arylsulfonate salt, optionally with the presence of a level-dyeing promoter.

7 Claims, 2 Drawing Sheets

POLYAMIDE YARN PROVIDED WITH A BUILT-IN ANTIBACTERIAL AND METHOD FOR ITS PRODUCTION

FIELD OF THE INVENTION

The present invention describes a polyamide yarn treated so as to possess built-in antimicrobial capacity, as well as a method for producing such a yarn. More specifically, the present invention describes improvements to the attachment to polyamide yarns of organosilicon quaternary ammonium salt antimicrobial agents. In particular, the present invention describes a polyamide yarn with improved durability: it will not pose the risk of uneven dyeing in any downstream dyeing finishing process while at the same time the antimicrobial effect will not be reduced. Also described is a method for producing such a polyamide yarn.

As used in the present invention, "built-in" means that the spun filament from the spinneret is provided with the treatment agent by any process before the first wind-up process.

Textile goods which have been antibacterially finished for hygiene have been known for some time. The following three properties are generally required in this area:

(i) a significant hygiene effect (ii) durability and (iii) high safety.

For example, the organosilicon quaternary ammonium salt with the formula given below is known as an antimicrobial agent, antimold and antialgal agent which satisfies these three requirements in each role. Japanese Patent Application Laid-open No. 51874/82 describes the uptake of this compound by a textile good such as dyed BCF nylon yarn.

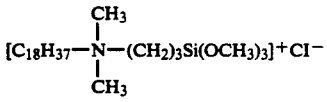

$$[C_{18}H_{37}-\underset{\underset{CH_3}{|}}{\overset{\overset{CH_3}{|}}{N}}-(CH_2)_3Si(OCH_3)_3]^+Cl^-$$

In addition a method has recently been proposed in which electrolyte salt and a $C_{8-18}$ unsaturated fatty acid or its salt are both added to the treatment solution of the above-mentioned quaternary ammonium salt in order to achieve a durable antimicrobial effect (Japanese Patent Application Laid-open No. 181364/85). A method has also recently been proposed in which a cationic finishing follows the aforementioned treatment (Japanese Patent Application Laid-open No. 185866/85).

The forms of textile goods which serve as the substrate for these treatments are raw fiber yarn (reel, cheese, etc.), cloth goods such as woven and knitted materials and piece goods of textile products (for example, refer to the lower right column on page 2 of Japanese Patent Application Laid-open No. 181364/85).

The present inventors recognized a flaw in the aforementioned treatments with the antimicrobial agent, which was absolutely neglected in the above proposals. That is, when a polyamide fiber adhered beforehand with the aforementioned antimicrobial agent is dyed, the antimicrobial effect after dyeing is significantly less than the antimicrobial effect before dyeing. This means that dyeing fibers or textile products which have been adhered beforehand with the antimicrobial agent is extremely risky, and the originally sought antimicrobial effect cannot be secured. This significantly affects production planning as well as the supply of antibacterially treated product to the customer.

Of course, various countermeasures can be devised in the dyeing process to avoid this decline in the antimicrobial effect, but no concrete proposals have as yet appeared. Even if such an art were to be established, the spread of antibacterially treated products still could not be expected as long as said art were to remain within the realm of only some dyers. In addition, this would complicate the dyeing process.

For this reason, the object of the present invention is to provide a polyamide yarn which carries an organosilicon quaternary ammonium salt and for which the antimicrobial effect after dyeing is essentially equivalent to the antimicrobial effect before dyeing. Another object of the present invention is to provide a method for producing said yarn.

A further object of the present invention is to provide a polyamide yarn which carries an organosilicon quaternary ammonium salt, which does not require countermeasures in the dyeing process to prevent a reduction in antimicrobial effect and which essentially does not undergo a variation in antimicrobial effect before and after dyeing.

In addition, another object of the present invention is to provide a polyamide yarn which carries an organosilicon quaternary ammonium salt and for which nonuniform dyeing, as well as a reduction in antimicrobial capacity do not occur in dyeing finishing.

DETAILED DESCRIPTION OF THE INVENTION

The present inventors discovered that the above objects can be simultaneously accomplished by the built-in adhesion of both an organosilicon quaternary ammonium salt and a specific anionic surfactant to the spun yarn and that these objects could be more favorably simultaneously accomplished by using a so-called built-in approach: the surface of the polyamide fiber is tightly adhered with an organosilicon quaternary ammonium salt and preferably then overcoated with a specific anionic surfactant and these treatments are conducted during the yarn spinning process.

In this way, the present invention provides (1) a polyamide yarn provided with a built-in antimicrobial capacity, with the characteristic that the fiber surface is adhered with both an antimicrobial agent comprising an organosilicon quaternary ammonium salt and a surfactant comprising an alkyl-, aryl-, alkenyl- or aralkylsulfonate salt, possibly with the presence of a level-dyeing promoter, (2) a method for producing a polyamide yarn provided with a built-in antimicrobial capacity, with the characteristic that spun polyamide yarn is adhered with both an antimicrobial agent comprising an organosilicon quaternary ammonium salt and a surfactant comprising an alkyl-, aryl-, alkenyl- or aralkyl- sulfonate salt, possibly in the presence of a level-dyeing promoter, and said yarn is then wound up, and (3) a method for producing a polyamide yarn provided with a built-in antimicrobial capacity, with the characteristic that spun polyamide yarn is adhered with both an antimicrobial agent comprising an organosilicon quaternary ammonium salt and a surfactant comprising an alkyl-, aryl-, alkenyl- or aralkyl- sulfonate salt, possibly in the presence of a level-dyeing promoter, at any stage leading to drawing/heat treatment, texturing or wind up of said yarn.

The present invention will be explained with reference to the accompanying drawings.

FIG. 1 is a schematic of a process in which organosilicon quaternary ammonium salt antimicrobial agent and the specific anionic surfactant (denoted simply as "surfactant" hereafter) are both adhered in the coupled spinning-drawing/heating of polyamide.

FIG. 2 is a schematic of a process in which a texturing step has been inserted into the process of FIG. 1 after drawing/heating.

In FIG. 1, polyamide filament 2 spun from spinneret 1 is cooled and solidified, treated with an antimicrobial agent containing spinning lubricant by oiling roll 3, passed over godet rolls 4 and 5 (5' is a separate roll) and then wound between heating roll 6 and separate roll 6' in order to conduct drawing and heating simultaneously.

Surfactant-containing treatment solution is then adhered to stretched yarn 7 by oiling roll 8 and this is then wound up at winder 9. In this process, the surfactant may be adhered to the spun yarn together with the antimicrobial agent (in such a case, added to the spinning lubricant) or, alternatively, the surfactant may be adhered as an afteroil. It is generally preferred that the antimicrobial agent and the surfactant be applied to the spun yarn before the godet roll 4 using the same or different baths. The process discussed below with reference to FIG. 2 remains the same as the instant process.

FIG. 2 gives one embodiment of the direct application of the process shown in FIG. 1 to spinning-drawing-texturing (SDTY). That is, in the apparatus of FIG. 2, filament 22 spun from spinneret 21 is passed over oiling roll 23, godet roll 24 and feed rolls 25 and 25', passed several times around hot rolls 26 and 26' (which rotate at a constant peripheral speed several times faster than the peripheral speed of rolls 25 and 25'), stretched between rolls 25 and 25' and rolls 26 and 26', introduced into and crimped in hot fluid-treatment nozzle 27, coated with surfactant by oiling roll 28, drafted by rolls 29 and 29', passed over guide 30 and then wound up at winder 31.

In FIGS. 1 and 2, the distinguishing features are that the antimicrobial agent is applied to a spun yarn whose molecular structure has not been completely stabilized and it is then heat-fixed on the filament surface in the following heating process, while the surfactant is overcoated under these conditions, and that these agents are all applied during the filament spinning process, so that a favorable yarn package is produced by a so-called built-in process.

FIG. 1 shows a coupled spinning-drawing process, but, in its place, a method may be used in high-speed spinning (≧3,000 m/min.) in which the antimicrobial agent is heat-fixed by means of a stretch of several tenths of percent between heated godet rolls and the surfactant is applied before wind up.

Furthermore, as disclosed in the specification of U.S. Pat. No. 3,803,282, in the processes in FIGS. 1 and 2, an interlacing nozzle may be installed between oiling roll 3 (23) and first godet roll 4 (24) in order to impart a slight interlace to the yarn and so improve the uniformity of adhesion of the antimicrobial agent and improve the workability in drawing (prevention of napping and lapping). However, the usual degree of interlacing (5 to 40 per meter) may be imparted to the yarn after drawing or texturing and before the winder in order to secure handling of the yarn after this. The interlacing process and the interlace number are discussed in detail in the specifications of U.S. Pat. Nos. 2,985,995 and 3,110,151.

In the drawings, the separate roll method and Nelson roll method (FIG. 2, 26, 26') are shown for the rolls, but their combination may be arbitrarily selected depending on one's requirements.

A hot-fluid finishing method, with its high speed capacity, is advantageously used as the texturing method because it may be assembled into a high-speed process such as coupled spinning-drawing.

Examples of such methods which may be used include methods in which the yarn is plastified with a hot fluid in a nozzle and crimped by stuffing in a pad or wad (the specifications of U.S. Pat. Nos. 4,188,691 and 4,268,940): methods in which the yarn is plastified with a hot fluid in a nozzle and is taken up as a loop yarn, cooled and then drafted and opened (the specifications of U.S. Pat. Nos. 3,186,155 and 3,543,353); and methods in which the yarn is plastified with a hot fluid in a nozzle, impinged and buckled against an air-permeable collision surface, cooled under these conditions and then taken up (the specification of U.S. Pat. No. 3,255,508 and the specification of British Patent No. 1,273,797).

Obviously, the polyamide flat yarn of FIG. 1 which has been wound up as a high-speed spun yarn, may later be finished in a crimping process (typified by the false-twisting process) or by a texturing process such as compounding with a polyurethane.

The antimicrobial agent used by the present invention is an organosilicon quaternary ammonium salt with the following general formula $$[R_1-\overset{\overset{R_2}{|}}{\underset{\underset{R_3}{|}}{N}}-(CH_2)_3-Si(OR_4)_3]^+X^-$$

(where $R_1$ is a $C_{8-22}$ long-chain alkyl group; $R_2$, $R_3$ and $R_4$ are all alkyl groups and X is $C_1$, Br, I or $CH_3COO$).

Such compounds can be produced by heating and reacting gamma-halopropyltrialkoxysilane with a tertiary amine such as alkyldimethylamine, aryldimethylamine, alkenyldimethylamine or aralkyldimethylamine, for example, lauryl($C_{12}$)dimethylamine, myristyl($C_{14}$)dimethylamine and cetyl($C_{16}$)dimethylamine. For example, dimethyloctadecyl(3-trimethoxysilyl)propylammonium chloride is commercially available from the Dow Corning Corporation (brand name, DOW CORNING ®5700 antimicrobial treatment agent), Shin-etsu Chemical Co., Ltd. and Petrarch Systems Inc. of the United States. It is generally supplied as a methanol solution containing approximately 50% effective component.

The quantity of uptake of said antimicrobial agent is 0.05 to 1.0% and preferably 0.1 to 0.8% based on the fiber weight. The desired antimicrobial effect cannot be generated when this quantity is less than 0.05%. On the other hand, exceeding 1.0% is uneconomical from a cost standpoint. As demonstrated in the tables, the quantity of antimicrobial agent in the spinning lubricant is generally 5 to 80 wt % in an advantageous practical embodiment of the process. The method of application of spinning lubricant or antimicrobial agent is not limited to oiling roll methods and any method commonly used in the art may be used, for example, metered oiling and spray methods.

The surfactant to be employed by the present invention is exemplified as follows.

a. Alkali metal or alkaline earth metal salts of alkylsulfonic acids:

Na: salt of laurylsulfonic acid,

K: salt of oleylsulfonic acid and ammonium salt of myristylsulfonic acid b. Alkali metal or alkaline earth metal salts of diarylsulfonic acids:

The Na salt of diphenyl oxide sulfonates,

The K salt of the above compound and

The Mg salt of the above compound.

A $C_{5-18}$ alkyl group may be substituted on one or both of the phenol groups in the above compound. In addition, the above compound may be used as the mixture of the monoalkylsubstituted and dialkyl-substituted products.

c. Alkali metal or alkaline earth metal salts of aralkylsulfonic acids:

The Na salt of dodecylbenzenesulfonic acid,

The K salt of nonylphenylsulfonic acid and

The ammonium salt of laurylphenylsulfonic acid.

These surfactants may be adhered to the filament simultaneous with application of the antimicrobial agent or, alternatively, they may be overcoated before wind up on the filament on which the antimicrobial agent has been heat-fixed. The specification for the uptake of surfactant at this time is the same as for the antimicrobial agent. The method for applying the surfactant may be the same as for the above-mentioned oiling or application of the antimicrobial agent. The surfactant is added at 5–80 wt % to the spinning lubricant or afteroil and is then applied to the yarn or, alternatively, it is dissolved by itself in a solvent such as water or alcohol and the resulting treatment solution with a concentration of 5–80% is applied to the yarn.

However, when the surfactant is added to spinning lubricant which contains the organosilicon quaternary ammonium salt, the stability of the spinning lubricant emulsion will sometimes change. Due to this, the emulsion stability of the surfactant containing spinning lubricant system must be re-adjusted.

In this regard, it is generally recommended that the surfactant be applied as an afteroiling agent separately from the spinning lubricant containing the organosilicon quaternary ammonium salt. On the other hand, the organosilicon quaternary ammonium salt is preferably applied to the undrawn yarn before heat treatment.

With the use in the present invention of a surfactant which is slightly cationic in the acid region as the level-dyeing promoter, and particularly with the use of such a nonionic type, level dyeing is improved, while the antimicrobial effect is further improved via a synergistic effect with the sulfonate salt surfactant.

As used herein, "slightly cationic in the acid region" has the following meaning:

A nitrogen-containing alkylene oxide adduct will exhibit a cationicity which, however, is relaxed by the presence of the alkylene oxide groups. As the hydrogen ion concentration is increased in the acid region, the nitrogen atoms are quarternized in part and the adduct exhibits cationicity. These compounds include POE(-polyoxyethylene)-laurylamino ethers and ethylene oxide (EO)+propylene oxide (PO) adducts of oleic acid diethanolamide. Concrete examples are POE(10-)laurylamino ether and the PO/EO (50%/50%) adduct of oleic acid diethanolamide with MW=2000.

The polyamide specified by the present invention generally refers to nylon-6 and nylon-66; however, obviously both homopolymers, and copolymers which contain ≦10 mol % other copolymerizable components, are included. In addition, the preceding homopolymers and copolymers may contain fiber-function improvers (for example, an antistatic spinning agent).

FUNCTIONS AND EFFECTS OF THE INVENTION

It remains unclear as to why dyeing does not affect retention of the polyamide yarn's antimicrobial effect as provided in the present invention.

Polyamide yarn is invariably dyed with acid dyes or metallized dyes; however, as is generally known, an anionic compound is added to the dye bath as a dye moderator or retarding agent. Due to this, the anions and the organosilicon quaternary ammonium salt cations are presumably attracted to each other by ionic interaction and the quaternary ammonium salt cation, which exhibits the antimicrobial effect, is masked and the microbiocidal activity is lost.

For this reason, a system of only organosilicon quaternary ammonium salt cannot exhibit any special microbiocidal activity due to the presence of ions of the dye or dye auxiliaries. Accordingly, this cannot be thought of as a built-in type antimicrobial fiber in the true sense.

Various methods were examined by the present inventors from this viewpoint in order to develop a built-in type antimicrobial fiber which would have a microbiocidal activity in various applications. The combination of the aforementioned agents provided for the invention of an antimicrobial fiber which would exhibit microbiocidal activity in any application and a method for its production.

That is, although the reason remains unclear, it was discovered that the advance application to the fiber of an alkali metal or alkaline earth metal salt of an alkyl-, aryl-, alkenyl- or aralkylsulfonic acid, although also an anion, would protect the antimicrobial effect from anionic dye-leveling agents and acid dyes.

The mechanism by which said agent protects the microbiocidal effect from anionic dye-leveling agents (for example, Migregal 2N® from Nippon Senka Kogyo Co., Ltd.) is not completely understood; however, it may be conjectured that said agent preferentially coordinates with the cation group of the quaternary ammonium salt and its coordination for some reason does not inhibit the microbiocidal property.

Due to this, a true built-in antimicrobial fiber is made possible which is not affected by various anionic auxiliaries and softening agents used in dyeing. However, the antimicrobial agent must be applied before stretching and heating for the following reason. When the organosilicon quaternary ammonium salt is applied after stretching and heating, the fiber will not be heat-fixed and will not be durable, with the result that the agent is subject to removal by a vigorous wash such as scouring, etc. Accordingly, antimicrobial effect is reduced.

The built-in yarn of the present invention has a durable antimicrobial capacity which is unaffected by dyeing and this yarn also has good level-dyeing properties. Due to this, dyeing of the yarn does not engender any particular risks and, the yarn may be dyed using standard dyeing conditions without any modification, without a reduction in antimicrobial properties. In other words, the yarn produced by the built-in regime absolutely will not require any antimicrobial treatment in a downstream finishing process subsequent to fiber production and before carpet production.

Accordingly, the process of manufacturing antimicrobial products is significantly rationalized. Due to this, the present invention provides, with greater economic efficiency, an excellent antimicrobial product which can be used for clothing articles such as socks, stockings and underwear, etc., or for carpet, or for mats serving as covering for building floors.

EXAMPLES

The present invention will be explained in detail with reference to examples of execution. The sterilization ratio specified herein is defined in the following.

ANTIBACTERIAL TEST

(1) Test Method

The sterilization ratio is determined by the shake flask method, which is an improved version of the AATCC Test Method 100 bioassay method.

AATCC Test Method 100

This method is a quantitative method for the evaluation of antimicrobial activity. AATCC broth culture medium, containing a specified number of microorganisms ($1-2\times10^5$ colony-forming units/mL) is infiltrated into untreated cloth and treated cloth, both of which have been sterilized in an autoclave. This is followed by cultivation at 37° C. for 18 hours. The number of viable microorganisms is measured by the plate dilution method, both before and after cultivation, on the solution obtained by extraction with phosphate buffer with vigorous shaking for one minute. The number of microorganisms on the textile is reported as the percentage decline relative to the viable count immediately after inoculation.

Shake Flask Method

This method is a quantitative method for the evaluation of antimicrobial activity. The sample is placed in diluted phosphate buffer which has been inoculated with the test bacterial solution ($1.5-3.0\times10^5$ colony-forming units/mL) and this is then shaken at room temperature or 25°-30° C. for a specified period of time (1 hour) in order to bring the sample forcibly into contact with the bacterial solution. The viable count is measured by the plate dilution method before (A) and after (B) contact by the treated fabric with the test organism. The percentage decline relative to the viable count before contact is reported.

$$\text{Sterilization ratio (\%)} = [(A - B)/A] \times 100$$

$A$ = microorganism count at time zero
$B$ = microorganism count after shaking for 1 hour

(2) Species of Bacterium

Klebsiella pneumoniae ATCC-4352

(3) The dyeability is evaluated on the following scale.

Good: Dyeing of the fabric is uniform, no barre

Fair: Intermediate between good and poor, slight dyeing unevenness is observed

Poor: Dyeing is nonuniform, significant barre

EXAMPLE 1

Using the process of FIG. 1, polycaproamide (nylon-6) polymer is melt-spun from a spinneret with 24 holes 0.4 mm in diameter. It is cooled and solidified, treated with a spinning lubricant which contains antimicrobial agent A using oiling roll 3, and then taken up with godet roll 4 rotating at a peripheral speed of 1,000 m/min. The yarn, now treated with lubricant, is drawn 3X and heated between feed roll 5, which is rotating at a peripheral speed of 1,050 m/min. and is heated to 50° C., and drawing roll 6 which is rotating at a peripheral speed of 3,150 m/min. and is heated to 180° C. It is then applied with the following surfactant treatment solution B using oiling roll 8. The resulting built-in antimicrobial yarn is wound up on winder 9. The following materials were used:

A. Antibacterial Agent 3-(Trimethoxysilyl)propyldimethyloctadecylammonium chloride

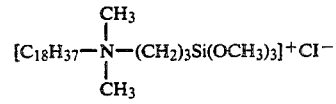

B. Surfactant Solution

Na sulfonates (mixture) of diphenyl oxide

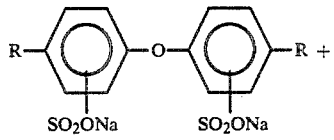

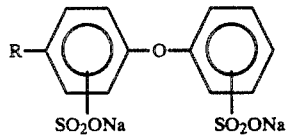

(where R is a $C_{10}H_{21}$ alkyl group) Uptake=0 or 0.6 wt %.

A tubular knit of the stretched yarn is immersed in dye bath C and dyed at 98° C. for 30 minutes. The antimicrobial capacity of the dyed fabric is then measured.

The Dye Bath Conditions were:

a. dyes:

Tectilon Yellow 4R (brand name of Ciba-Geigy Corp.): 0.08% (o.w.f.)

Tectilon Red FRLL (brand name of Ciba-Geigy Corp.): 0.14% (o.w.f.)

Tectilon Blue 6G (brand name of Ciba-Geigy Corp.): 0.1015% (o.w.f.)

b. dye leveler: Migregal 2N® anionic surfactant (from Nippon Senka Kogyo Co., Ltd.): 2.0% (o.w.f.)

c. Bath ratio: 1:100 dye/solution based on weight d. Bath pH: 7

TABLE 1

| No. | Quantity of Antibacterial Agent A (%) | Surfactant B, % | Sterilization Ratio, % |
|---|---|---|---|
| 1 | 0 | 0 | 0 |
| 2 | 0 | 0.6 | 0 |
| 3 | 0.6 | 0 | 23 |
| 4 | 0.6 | 0.6 | 100 |

The results, which are reported in Table 1, demonstrate that a good sterilization ratio and level dyeing cannot be obtained without the joint use of antimicrobial agent and surfactant according to the present invention.

EXAMPLE 2

Using the process of FIG. 2, a polycaproamide (nylon-6) polymer is melt-spun in a trilobar cross section from a spinneret having 68 holes (slit width, 0.2 mm: slit length, 1.3 mm) and then cooled and solidified. It is then treated with the same lubricant containing antimicrobial agent A as in Example 1 using oiling roll 23, and then taken up by godet roll 24 which is rotating at a peripheral speed of 800 m/min. The yarn, now treated with lubricant, is drawn 3.2X and heated between feed roll 25, which is rotating at a peripheral speed of 820 m/min and is heated to 50° C. and drawing roll 26, which is rotating at a peripheral speed of 2,600 cm/min. and is heated to 185° C. It is then introduced into and crimped in a fluid-stuffing nozzle as disclosed in FIG. 1 of U.S. Pat. No. 4,268,940 (the nozzle dimensions are reported therein in Table 2 of Example 1) at a hot fluid temperature of 210° C. It is then treated with the following surfactant treatment solution B using oiling roll 28, taken up with draft roll 29, which is rotating at a peripheral speed of 2,400 m/min., passed over guide 30 and then wound up at winder 31.

Using this process, an experiment is also conducted in which antimicrobial agent A and surfactant B are both added to the spinning lubricant applied to the yarn using oiling roll 23 and an experiment is conducted in which both A and B are simultaneously applied to the yarn using oiling roll 28.

B. Surfactant Solution

B-1: Na sulfonate salts (mixture) of diphenyl oxide

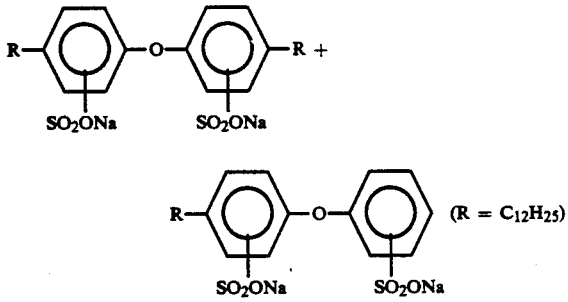

B-2: aliphatic amine ethoxylate (added as a level-dyeing promoter)

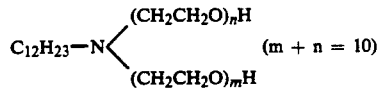

The BCF (bulky continuous filament) produced as above is made into carpet which is then immersed in the following dye bath C and then steamed at 98° C. for 5 minutes in order to fix the dye. The antimicrobial capacity (sterilization ratio) of the dyed carpet is measured and the results are reported in Table 2.

C. Dye Bath a. Dyes

Case 1 (acid dye)

Tectilon Yellow 4R (brand name of Ciba-Geigy Corp.): 0.0805% (o.w.f.)

Tectilon Red FRLL (brand name of Ciba-Geigy Corp.): 0.014% (o.w.f.)

Tectilon Blue 6G (brand name of Ciba-Geigy): 0.1015% (o.w.f.)

Case 2 (metal-containing dye)

Lanasyn Black BRL (brand name of Sandoz Ltd.): 0.100% (o.w.f.)

Irgulon Yellow 2BRL (brand name from Ciba-Geigy Corp.): 0.012% (o.w.f.)

Lanasyn Bordeaux RL (brand name of Sandoz Ltd.): 0.003% (o.w.f.)

b. dye levelers:

Case 1

Anionic dye leveler, Migregal 2N ® (brand name of Nippon Senka Kogyo Co., Ltd.): 2.0% (o.w.f.)

Case 2

Nonionic dye leveler, Ceropol DR-80 (brand name of Sanyo Chemical Industries. Ltd.): 2.0% (o.w.f.)

Bath ratio: 1 = 100.

Tectilon Red FRLL (brand name of Ciba-Geigy Corp.): 0.014% (o.w.f.)

Tectilon Blue 6G (brand name of Ciba-Geigy): 0.1015% (o.w.f.) Case 2 (metal-containing dye) Lanasyn Black BRL (brand name of Sandoz Ltd.): 0.100% (o.w.f.)

Irgulon Yellow 2BRL (brand name from Ciba-Geigy Corp.): 0.012% (o.w.f.)

Lanasyn Bordeaux RL (brand name of Sandoz Ltd.): 0.003% (o.w.f.)

b. dye levelers:

Case 1 Anionic dye leveler, Migregal 2N ® (brand name of Nippon Senka Kogyo Co., Ltd.): 2.0% (o.w.f.)

Case 2 Nonionic dye leveler, Ceropol DR-80 (brand name of Sanyo Chemical Industries, Ltd.): 2.0% (o.w.f.)

Bath ratio: 1=100.

TABLE 2

| No. | Antibacterial Agent A | Surfactant B-1 | Level-Dyeing Promoter B-2 | Dye Leveler | Dye | Sterilization Ratio (%) | Level Dyeing |
|---|---|---|---|---|---|---|---|
| 5 | 0.6% | 0% | 0% | none | acid | 70 | poor |
| 6 | 0.6 | 0 | 0 | none | metallized | 90 | poor |
| 7 | 0.6 | 0 | 0 | anionic | acid | 18 | fair |
| 8 | 0.6 | 0 | 0 | anionic | metallized | 23 | fair |

TABLE 2-continued

| No. | Antibacterial Agent A | Surfactant B-1 | Level-Dyeing Promoter B-2 | Dye Leveler | Dye | Sterilization Ratio (%) | Level Dyeing |
|---|---|---|---|---|---|---|---|
| 9 | 0.6 | 0 | 0 | nonionic | acid | 75 | fair |
| 10 | 0.6 | 0 | 0 | nonionic | metallized | 85 | fair |
| 11 | 0.6 | 0.6 | 0 | none | acid | 90 | poor |
| 12 | 0.6 | 0.6 | 0 | none | metallized | 93 | poor |
| 13 | 0.6 | 0.6 | 0 | anionic | acid | 80 | fair |
| 14 | 0.6 | 0.6 | 0 | anionic | metallized | 85 | fair |
| 15 | 0.6 | 0.6 | 0 | nonionic | acid | 92 | fair |
| 16 | 0.6 | 0.6 | 0 | nonionic | metallized | 95 | fair |
| 17 | 0.6 | 0 | 0.6 | none | acid | 90 | good |
| 18 | 0.6 | 0 | 0.6 | none | metallized | 92 | good |
| 19 | 0.6 | 0 | 0.6 | anionic | acid | 43 | good |
| 20 | 0.6 | 0 | 0.6 | anionic | metallized | 51 | good |
| 21 | 0.6 | 0 | 0.6 | nonionic | acid | 90 | good |
| 22 | 0.6 | 0 | 0.6 | nonionic | metallized | 92 | good |
| 23 | 0.6 | 0.6 | 0.6 | none | acid | 100 | good |
| 24 | 0.6 | 0.6 | 0.6 | none | metallized | 100 | good |
| 25 | 0.6 | 0.6 | 0.6 | anionic | acid | 100 | good |
| 26 | 0.6 | 0.6 | 0.6 | anionic | metallized | 100 | good |
| 27 | 0.6 | 0.6 | 0.6 | nonionic | acid | 100 | good |
| 28 | 0.6 | 0.6 | 0.6 | nonionic | metallized | 100 | good |

Notes:
(1) The antimicrobial agent is applied to the yarn by addition to the spinning lubricant.
(2) The surfactant is applied to the yarn as an afteroil.

As demonstrated in Table 2, the combination (No. 11-16) of antimicrobial agent A plus B-1 is sufficient to obtain an antimicrobial effect in the dyed fabric, but it is readily comprehended that the joint use (No. 23-28) of B-2 is preferred in order further to secure level dyeing.

Table 3 demonstrates the relationship between the quantity of uptake of antimicrobial agent and surfactant and the sterilization ratio.

TABLE 3

| No. | Anti-bacterial Agent A (%) | Surfac-tant B-1 (%) | Dye Leveler | Dye | Sterilization Ratio (%) |
|---|---|---|---|---|---|
| 29 | 0 | 0.6 | anionic type (Migregal 2N) | acid | 0 |
| 30 | 0.1 | 0.6 | anionic type (Migregal 2N) | acid | 90 |
| 31 | 0.3 | 0.6 | anionic type (Migregal 2N) | acid | 100 |
| 32 | 0.6 | 0.6 | anionic type (Migregal 2N) | acid | 100 |

In addition, Table 4 shows the difference in effects obtained for the addition of antimicrobial agent and surfactant, respectively, before and after drawing/heating.

TABLE 4

| | Addition in Lubricant (before drawing/heating) | | | Addition in Afteroil (after drawing/heating) | | | | |
|---|---|---|---|---|---|---|---|---|
| No. | Antibacterial Agent A | Surfactant B-1 | Level-dyeing Promoter B-2 | Anti-Bacterial Agent A | Surfactant B-1 | Level-Dyeing Promoter B-2 | Steriliza-tion Ratio (%) | Level Dyeing |
| 33 | yes | yes | no | no | no | no | 100 | fair |
| 34 | yes | yes | yes | no | no | no | 100 | good |
| 35 | no | no | no | yes | no | no | 40 | fair |
| 36 | no | no | no | yes | yes | yes | 98 | good |
| 37 | yes | no | no | no | yes | yes | 100 | good |

Notes:
The uptake of each agent is 0.6 wt % based on the yarn
The dye is an anionic type and the dye leveler is an anionic type

BRIEF DESCRIPTION OF THE DRAWINGS

In FIG. 1 (FIG. 2),

1(21)—spinneret
2(22)—spun filament
3(23)—oiling roll
4(24)—godet roll
5(25)—feed roll
6(26)—drawing roll
7—drawn yarn
8(28)—surfactant-application roll
9(31)—winder.

Figure 1:
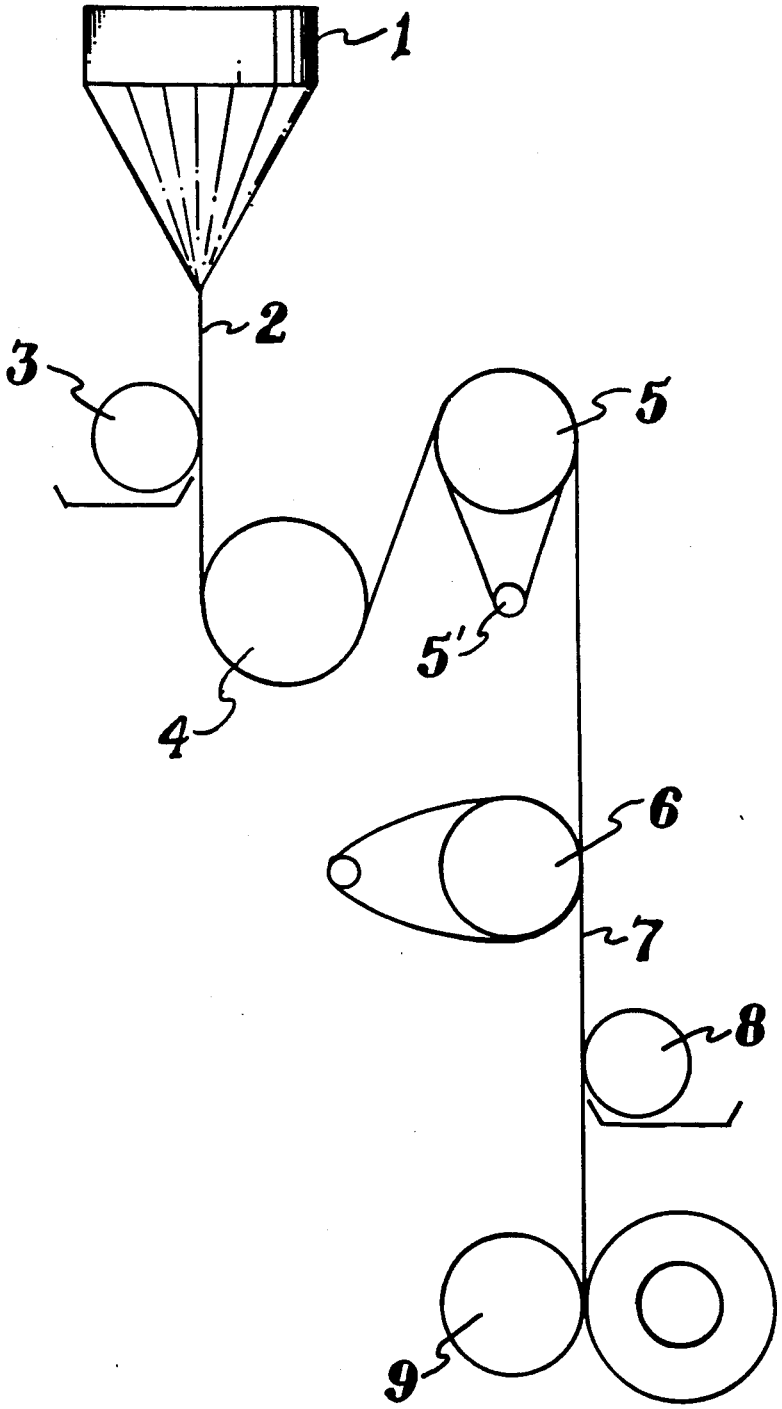
FIGS. 1 and 2 are both schematics of processes by which the antimicrobial polyamide yarn of the present invention is produced by a built-in regime.
Figure 2:
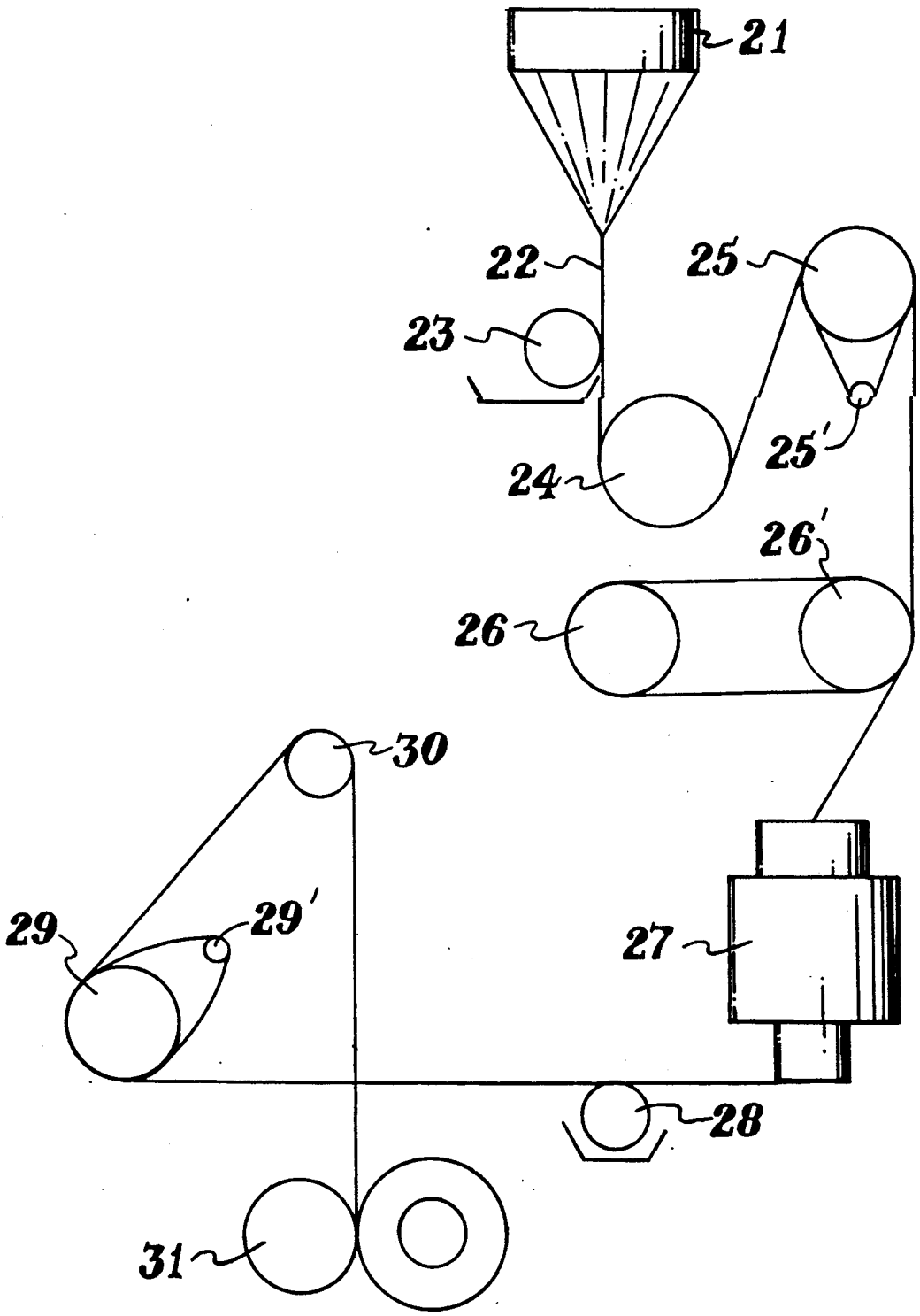

In FIG. 2,

27—fluid-finishing nozzle
29—draft roll.

What is claimed is:

1. Polyamide yarn comprising a melt spun continuous polyamide undrawn filament, the filament having a molecular structure that has not been completely stabilized, the surface of the filament having fixed and adhered thereto both an organosilicon quaternary ammonium salt and a surfactant selected from the group consisting of alkyl, aryl, and aralkylsulfonate salts.

2. The yarn as described in claim 1, wherein the organosilicon quaternary ammonium salt has the general formula

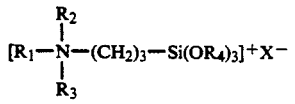

wherein $R_1$ is a $C_{8-22}$ long-chain alkyl group; $R_2$, $R_3$ and $R_4$ are each alkyl groups; and X is Cl, Br, I or $CH_3COO$.

3. The yarn as described in claim 2, wherein the organosilicon quaternary ammonium salt is 3-(trimethoxysilyl)-propyldimethyl-octadecylammonium chloride with the following formula

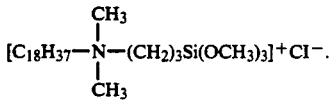

4. The yarn as described in claim 3, wherein the surfactant is a sulfonate of diphenyl oxide with the following formula

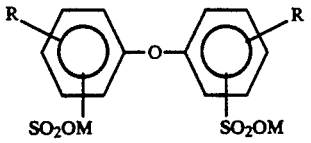

wherein M is an alkali metal, alkaline earth metal salt, or ammonium; and R is hydrogen, or a $C_{5-18}$ alkyl group.

5. The yarn as described in claim 4, wherein the organosilicon quaternary ammonium salt and the surfactant are fixed and adhered to the surface of the filament in the presence of a level-dyeing promoter which is a nonionic surfactant slightly cationic in the acid region.

6. The yarn as described in claim 5, wherein the level-dyeing promoter is a polyoxyethylene-laurylamino ether.

7. The yarn as described in claim 5, wherein the level-dyeing promoter is the ethylene oxide, propylene oxide, adduct of oleic acid diethanolamide.

* * * * *